United States Patent [19]

Kotkins, Jr.

[11] Patent Number: 4,773,515

[45] Date of Patent: Sep. 27, 1988

[54] MULTI-COMPARTMENT, EXPANSIBLE LUGGAGE BAG

[75] Inventor: Henry L. Kotkins, Jr., Seattle, Wash.

[73] Assignee: Skyway Luggage Company, Seattle, Wash.

[21] Appl. No.: 43,837

[22] Filed: Apr. 28, 1987

[51] Int. Cl.[4] ..... A45C 7/00; A45C 13/10

[52] U.S. Cl. ..... 190/103; 190/109; 190/111; 190/112; 190/903; 383/2; 383/97

[58] Field of Search ..... 190/103-105, 190/109, 111, 112, 903; 383/2, 97; D3/71, 72

[56] References Cited

U.S. PATENT DOCUMENTS

| | | | |
|---|---|---|---|
| D. 285,748 | 9/1986 | Feinberg et al. | D3/71 X |
| D. 286,229 | 10/1986 | Knoepke et al. | D3/71 X |
| 1,460,016 | 6/1923 | Emery | 190/109 X |
| 3,443,671 | 5/1969 | Dyke | 383/97 X |
| 4,236,615 | 12/1980 | Ginat | 190/103 X |
| 4,334,601 | 6/1982 | Davis | 190/111 X |
| 4,361,215 | 11/1982 | Sawai | 190/103 X |
| 4,437,549 | 3/1984 | Gibbs | 190/109 |

FOREIGN PATENT DOCUMENTS

| | | | |
|---|---|---|---|
| 1549246 | 12/1968 | France | 190/111 |
| 2374866 | 8/1978 | France | 190/103 |
| 2080220 | 2/1982 | United Kingdom | 190/103 |

*Primary Examiner*—William Price
*Assistant Examiner*—Sue A. Weaver
*Attorney, Agent, or Firm*—Seed and Berry

[57] ABSTRACT

A multi-compartment, expansible luggage bag has a main storage compartment with one or more expansible joints to increase the size of the main storage compartment. In conjunction with the main storage compartment, there is also provided a separable end storage compartment having an inner flexible membrane that can be extended inwardly beyond each of the expansion joints to maximize the volume of the end storage compartment when the expansion joints are open.

3 Claims, 2 Drawing Sheets

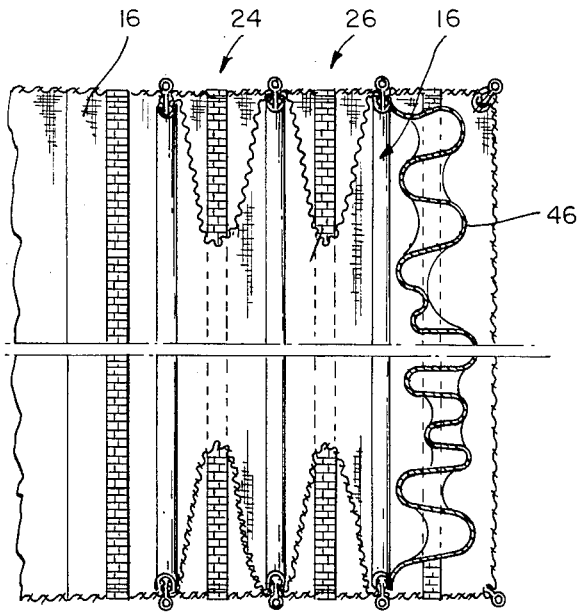
FIG. 3
FIG. 4
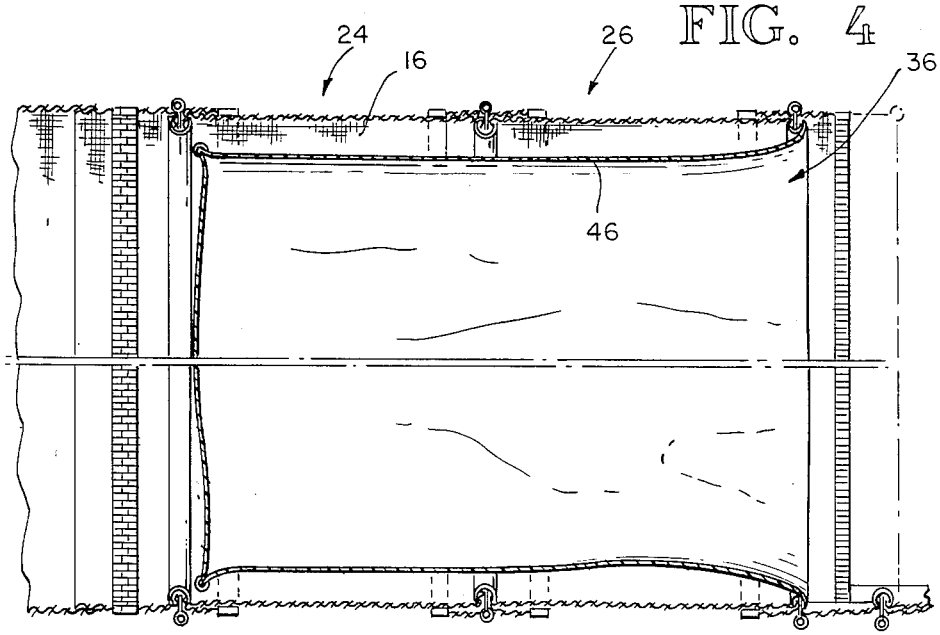

MULTI-COMPARTMENT, EXPANSIBLE LUGGAGE BAG

DESCRIPTION

1. Technical Field

This invention pertains to a soft, multi-compartment, expansible luggage bag in which is provided one or more expansible joints to extend the volume of the bag and which is also provided with one or more separate end compartments either extendible or collapsible to provide a large variety of combinations of a main compartment and end storage compartments within the bag.

2. Background Art

Expansible carrying cases are shown in U.S. Pat. No. 3,443,671. The case in this patent is provided with an expansible joint closed by an elongated zipper. When the zipper is opened, the joint can expand to increase the volume of the main storage compartment of the carrying case. Expansible carrying cases of the type shown in this patent are quite useful but are limited in their versatility.

It is also known to have end storage compartments on luggage which enable the user to choose between a main compartment of the luggage or a separate end storage compartment. An end storage compartment is particularly useful by making that portion of the bag waterproof so that damp garments, for example, can be kept separate from the other clothing in the main storage compartment of the bag. These end storage compartments are normally defined by a dividing wall separating the main storage compartment from the end storage compartment. The dividing wall is generally capable of little movement, and thus the end storage compartment is not expandible.

DISCLOSURE OF THE INVENTION

It is an object of this invention to provide an expandible main compartment and separate, variable volume or expandible end compartments to greatly increase the combinations of the main and end compartment storage volumes.

It is still another object of the invention to provide a multi-compartment, expandible luggage bag in which separate end compartments overlie the expansion joints and may extend inwardly into the main storage compartment to provide either small end storage compartments and a large main storage compartment or a small main storage compartment and a large end storage compartment.

Basically, these objects are obtained by providing one or more expansible joints on one or both ends of the luggage bag. End compartments are provided at the end of the bag with a flexible, collapsible membrane that can be either contracted for a small volume storage space or extended into the main compartment for a large volume storage space, particularly when all of the expansion joints are open to provide a much larger end storage compartment.

The advantages obtained by the invention are best achieved by having expansion joints on both ends of the bag and separate storage compartments also on both ends of the bag. This gives the user the utmost in versatility in storing and arranging the storage compartments in the luggage bag for either small volumes or large volumes while maintaining separation between the main and end storage compartments, as is desired.

Multiple smaller expansions are preferable to single large expansions, particularly when used on both ends, because in combination they provide more versatility in achieving incremental increases in packing capacity.

BRIEF DESCRIPTION OF THE DRAWINGS

FIG. 3 is a partial section taken along the line 3—3 of FIG. 1.

FIG. 4 is a partial section taken along the line 4—4 of FIG. 2, showing the bag in its fully extended, expanded position and the end storage compartment in its fully extended condition.

BEST MODE FOR CARRYING OUT THE INVENTION

Figure 1:
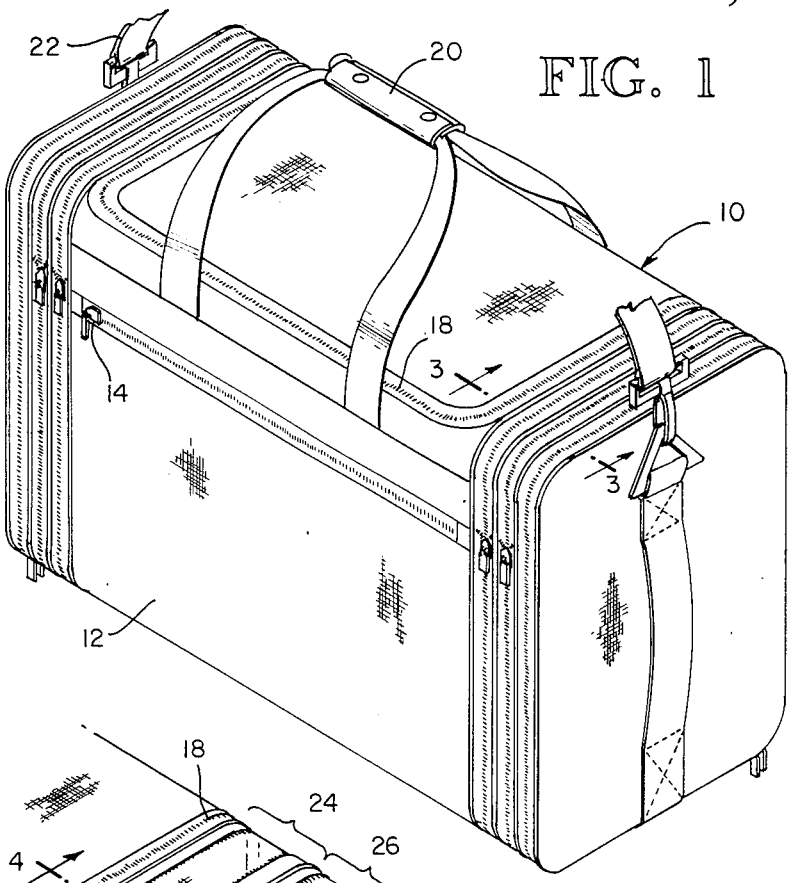
FIG. 1 is an isometric of a luggage bag embodying the principles of the invention.
Figure 2:
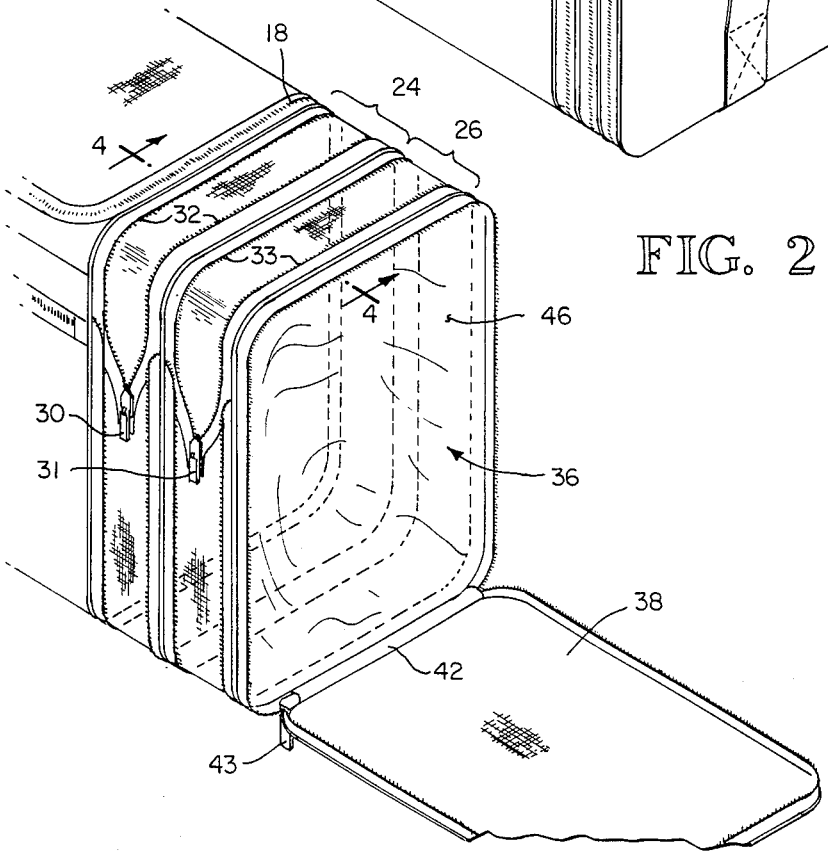
FIG. 2 is a partial view of the bag shown in FIG. 1 with expansion joints and an end storage compartment opened.

As best shown in FIG. 1, the bag 10 has a conventional side compartment 12 closed by a zipper 14 and a main storage compartment 16 closed by a zipper 18. The bag can have top handles 20 and a shoulder strap 22. Preferably, the bag is made of a heavy, flexible, soft material, such as woven nylon fabric.

At each end of the bag is provided a set of two expansible expansion joints 24 and 26. In the alternative, only one expansion joint need be provided on each end of the bag, or one or more expansion joints provided only at one end. Preferably, to gain the utmost in versatility, there should be at least two expansion joints on each end of the bag. The expansion joints are identical and are of the type shown in U.S. Pat. No. 3,443,671. Each expansion joint has a slide fastener 30 and 31 and adjacent zipper tracks 32 and 33. One end of the zipper tracks underlies the opposite end of the zipper track in overlapping relationship, such that when the expansion joint is closed, the slide fasteners 30 and 32 appear as in FIG. 1, looking like normal zippers. When the expansion joint is opened by the zipper being opened, the joint can be opened 360 degrees around its circumference. By having two expansion joints, the joints can be used together to get the maximum volume expansion in the bag or can be used separately to get an intermediate amount of expansion.

Also provided at each end of the bag is an end storage compartment 36 closed by a flap 38 and an end zipper 43. The end zipper goes all the way around the end of the bag, with the exception of a hinge area 42 which secures the flap integrally with the end of the bag. The end storage compartment is formed of an expandible, flexible, waterproof membrane 46.

The unique combination of the flexible joints and the extendible membrane of the end storage compartment is best shown in FIGS. 3 and 4. FIG. 3 illustrates the bag in its most retracted condition. In this position, the zippers 30 and 31 are closed, and the membrane 46 of the end storage compartment is in a retracted condition. The main storage compartment extends all the way to the right, beyond the expansion joint 26, and the end storage compartment is in its smallest condition.

In FIG. 4, the expansion joints are fully open and the membrane 46 of the end storage compartment 36 is extended inwardly to a location in which it extends past the innermost expansion joint 24. Obviously, other intermediate positions of both the amount of expansion of the bag and the amount of inward expansion of the membrane 46 are available to the user of the luggage bag.

As an example of use of the bag, if the user were to take the bag to a beach, all of the dry beachwear could be placed in the main storage compartment. Upon returning, however, the damp or soiled beachwear could be placed in the watertight end storage compartment 36. The end storage compartment could be enlarged by opening both expansion joints 24 and 26 to provide the maximum storage volume sufficient to handle not only the beachwear but also towels, sandals and other garments.

While the preferred embodiments of the invention have been illustrated and described, it should be understood that variations would be apparent to one skilled in the art. Accordingly, the invention is not to be limited to the specific embodiments shown in the drawings.

I claim:

1. A multi-compartment, expansible luggage bag having a main storage compartment with at least a first expansible joint and a separate end storage compartment, said expansible joint having a zipper which, when closed, collapses the expansible joint and, when opened, expands the expansible joint, said end storage compartment having a closure for opening and closing the end storage compartment and said separate end storage compartment having a flexible membrane of a depth that allows the separate and storage compartment to extend into the bag main storage compartment to create a versatile expansible bag having separated main and end storage compartments, each of which is expandible one toward the other.

2. The bag of claim 1, said bag including a second expansible joint adjacent said first expansible joint to form a first set of two adjacent expansible joints, said end storage compartment membrane being extendible into both such expansible joints.

3. The bag of claim 2, said bag including a second set of two adjacent expansible joints on a second end of the bag opposite the end of the bag with the first two expansible joints said second bag end having an end storage compartment adjacent said second set of expansible joints with a membrane extending inwardly of said expansible joints at said second end of said bag to form three separate compartments in the bag.

* * * * *

UNITED STATES PATENT AND TRADEMARK OFFICE

CERTIFICATE OF CORRECTION

PATENT NO. : 4,773,515

DATED : September 27, 1988

INVENTOR(S) : Henry L. Kotkins, Jr.

It is certified that error appears in the above-identified patent and that said Letters Patent is hereby corrected as shown below:

Column 4, line 5, delete "and storage" and substitute therefor --end storage--.

Signed and Sealed this

Fourteenth Day of February, 1989

*Attest:*

DONALD J. QUIGG

*Attesting Officer*

*Commissioner of Patents and Trademarks*